United States Patent [19]

Leifeld

[11] Patent Number: 4,470,172

[45] Date of Patent: Sep. 11, 1984

[54] APPARATUS FOR OPENING AND CLEANING FIBER TUFTS

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 397,405

[22] Filed: Jul. 12, 1982

[30] Foreign Application Priority Data

Jul. 11, 1981 [DE] Fed. Rep. of Germany ..... 3127544

[51] Int. Cl.[3] ..... D01G 9/06; D01G 9/16

[52] U.S. Cl. ..... 19/202; 19/64.5; 19/97.5; 19/105; 19/205

[58] Field of Search ..... 19/95, 97.5, 105, 107, 19/112, 200, 202, 204, 205, 64.5

[56] References Cited

U.S. PATENT DOCUMENTS 3,172,165 3/1965 Helm ..... 19/205 X 3,470,588 10/1969 Just ..... 19/202

*Primary Examiner*—Louis Rimrodt

*Attorney, Agent, or Firm*—Spencer & Frank

[57] ABSTRACT

Apparatus for opening and cleaning fiber tufts, composed of a rotatably mounted cylinder with a card clothing mounted on its circumference for gripping tufts and conveying them, a system for pneumatically feeding a mixture of tufts and air toward the cylinder circumference to strike the cylinder while traveling in a direction having a component opposite to the direction of movement of the portion of the cylinder which is struck by the mixture, cleaning elements operatively associated with the cylinder, a wall defining with the cylinder an air gap extending in the direction of flow of such mixture, and a system for discharging cleaned tufts.

4 Claims, 5 Drawing Figures

APPARATUS FOR OPENING AND CLEANING FIBER TUFTS

BACKGROUND OF THE INVENTION

The present invention relates to an apparatus for opening and cleaning fiber tufts, particularly of cotton, the apparatus being of the type including a cylinder provided with card clothing and disposed downstream of a feeding apparatus for gripping the fiber material and transporting it on. Cleaning elements, such as a grate, blades, fixed carding elements or the like and a discharge device are associated with such cylinder.

In a known opener and cleaner which operates without fast-holded stroke, impurities are pressed through the gap passages into the card clothing so that the clothing is deformed. Although this cleaner exhibits a relatively good cleaning effect, this drawback has been found to be very annoying in practical operation.

SUMMARY OF THE INVENTION

It is therefore an object of the present invention to provide an apparatus of the above-mentioned type which is free of the above-stated drawbacks and in which no impurities can be pressed into the clothing, particularly through the gap passages.

The above and other objects are achieved, according to the invention, by the provision of apparatus for opening and cleaning fiber tufts, composed of a rotatably mounted cylinder with a card clothing mounted on its circumference for gripping tufts and conveying them, means for pneumatically feeding a mixture of tufts and air toward the cylinder circumference to strike the cylinder while traveling in a direction having a component opposite to the direction of movement of the portion of the cylinder which is struck by the mixture, cleaning elements operatively associated with the cylinder, a wall defining with the cylinder an air gap extending in the direction of flow of such mixture, and means for discharging cleaned tufts.

In operation of the apparatus according to the invention, the fiber tufts are blown onto the clothed cylinder by means of a stream of air passing through a constriction. The clothed cylinder rotates in a direction opposite to the delivered stream of fiber tufts and air. The teeth of the clothed cylinder are arranged in such a manner that they catch the fiber tufts out of the stream of air and carry them along. The circumferential velocity of the clothed cylinder must be as high as possible so that a draft is present when the tufts land on the cylinder. The stream of air not only transports the fiber tufts, but also holds them tight against the attacking teeth. This causes the fiber tufts to be opened.

The opened tufts are then fed by the teeth of the clothed cylinder to cleaning elements such as blades, carding cylinders, fixed carding segments or the like which are operatively positioned relative to the circumference of the clothed cylinder and which separate impurities, such as pieces of leaves, stems, peppercorns or the like from the fiber material. The transporting air flows through the gap between the clothed cylinder and the wall surrounding the clothing.

In addition to producing good and especially gentle opening of the fiber tufts, the apparatus according to the invention prevents impurities from being pressed into the clothing through gap passages so that malfunctions caused thereby are eliminated.

Preferably, the feeding device is a channel which narrows in the direction of flow, with the clothed cylinder being disposed in the region of the constriction. Advisably, an air permeable comb is provided in the immediate vicinity, and ahead of the constriction so as to deflect tufts in the direction toward the clothed cylinder. The comb has narrow slits whose width is less than the size of the fiber tufts. The transporting air flows through the narrow slits, takes along the dust released from the tufts by the impact with the comb and is then extracted, if required, by means of a suction source.

Advantageously, at least one opening is provided in the channel wall after, and in the immediate vicinity of, the constriction, the opening being connected to a source of suction air. This removes excess transporting air and an accumulation of air is avoided in this way.

The invention will now be described in greater detail with the aid of embodiments which are illustrated in the drawings.

DESCRIPTION OF THE PREFERRED EMBODIMENTS

Figure 1:
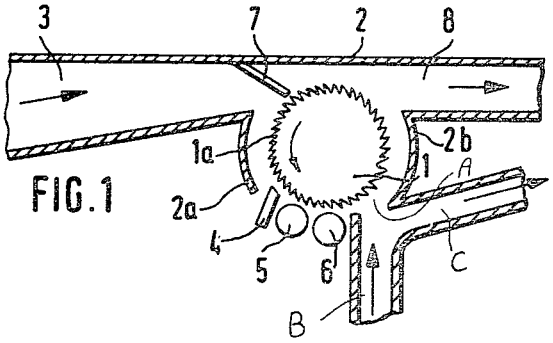
FIG. 1 is a simplified side elevational view of one preferred embodiment of apparatus according to the invention with a comb.

FIG. 1 shows a clothed cylinder 1, i.e. a cylinder whose circumferential wall is covered with clothing 1*a*, which rotates counterclockwise to continuously offer a new clothing surface to a stream of air laden with cotton. The clothed cylinder 1 is surrounded by a wall having sections 2, 2*a*, 2*b*. A channel 3 is provided as the feeding device through which fiber tufts are conveyed pneumatically, i.e. by an entraining air stream, onto the clothed roller 1. The channel 3 narrows in the direction of flow and, in the region of the clothed roller 1, where it meets the wall 2, 2*a*, it forms a constricted section. Between the clothed cylinder 1 and the wall section 2 there is an air gap through which the transporting air flows out. The clothing 1*a* of the clothed cylinder 1 has an associated cutting blade 4 and two work rolls 5 and 6. In the immediate vicinity of the constriction of channel 3 there is provided an air permeable comb 7 whose one end is fastened to the wall of channel 3 and whose other end is open. The spaces between the teeth of comb 7, and the space between comb 7 and clothing 1*a*, are smaller than the tufts and those teeth deflect the fiber tufts in the direction toward clothed cylinder 1.

During operation, the fiber tufts are supplied pneumatically through the channel 3, in the direction of the arrow. The fiber tufts which abut, with the stream of air, against the comb 7 slide along the teeth of the comb 7, are gripped by the clothing 1*a* of the clothed cylinder 1 and are transported further into the channel between the wall 2*a* and the clothing 1*a*. Blade 4 and work rolls 5 and 6 cause impurities to be separated from the opened fiber tufts, i.e. clean the tufts. The stream of transporting air and the dust flowing through the teeth of the comb 7 and through the gap between clothing 1*a* and wall 2 and are then extracted through channel 8 (see arrow).

The fiber tufts are caught in the clothing 1*a* and reach the area of an opening A in the wall which follows the wall portion 2*b* in the direction toward the roll 6. Air is blown in the direction toward opening A through a channel B so that the tufts are blown out of the clothing 1*a* and can be removed through channel C.

Figure 2:
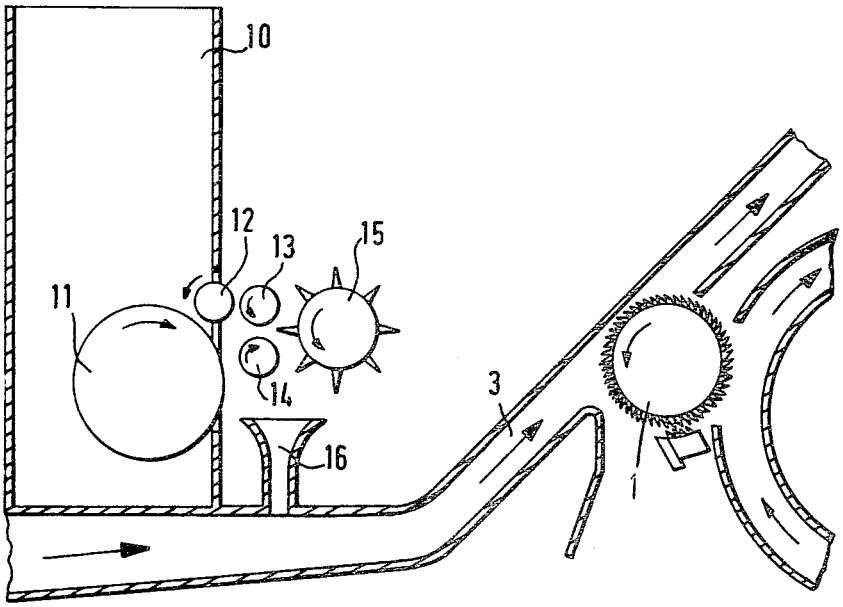
FIG. 2 is a similar view of an embodiment of apparatus according to the invention with tuft feed.

FIG. 2 shows an embodiment of the invention associated with a tuft feeding device which feeds the fiber tufts into the channel 3. The tuft feeding device includes a fill shaft 10 whose lower end contains an associated rotatably mounted suction drum 11. The fiber tufts are supplied through an opening in the wall of fill shaft 10 by a delivery roll 12 and two feed rolls 13, 14 to a needle roll 15 which feeds the tuft material into a funnel 16 disposed therebelow. The funnel 16 is connected to the channel 3 in which the fiber tufts are conveyed pneumatically in the direction toward the clothed cylinder 1. Cylinder 1 and its associated clothing constrict channel 3 to a width smaller than the size of the fiber tufts.

Figure 3A:
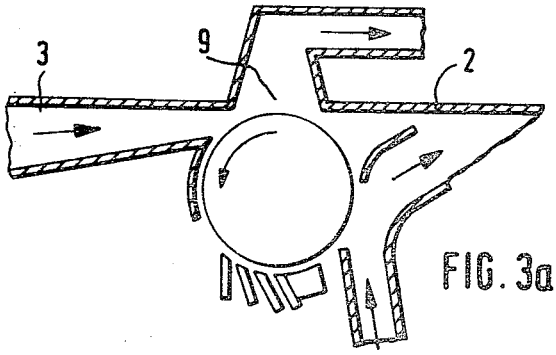
FIG. 3*a* is a similar view of an embodiment of apparatus according to the invention with a suction opening in the channel wall.

In the embodiment shown in FIG. 3*a*, an opening 9 is provided in the immediate vicinity of, and beyond, the constriction of channel 3. This opening is disposed opposite the clothing 1*a*, of the clothed cylinder 1. The opening 9 is connected, via a conduit, to a suction source (not shown).

Figure 3B:
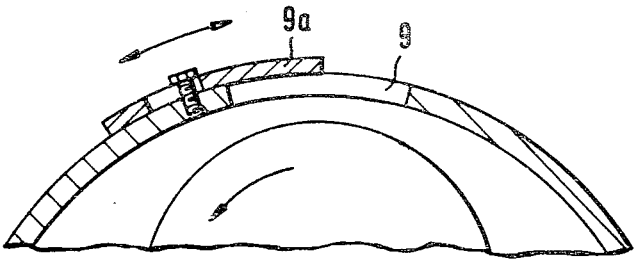
FIG. 3*b* is a cross-sectional detail view of a portion of apparatus according to the invention with a variable opening.

As shown in FIG. 3*b*, the opening 9 can be closed by means of a displaceably mounted cover 9*a* so that the amount of transporting air to be removed can be adjusted.

Figure 3C:
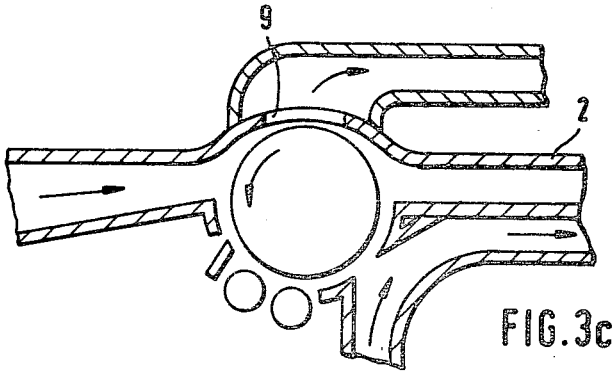
FIG. 3*c* is a cross-sectional view of a further embodiment of apparatus according to the invention with a curved opening.

FIG. 3*c* shows an embodiment in which the wall 2 in the region of the opening 9 opposite the clothed cylinder 1 is curved so that the wall 2 and the opening 9 are essentially adapted to the curvature of the clothed cylinder 1.

The clothing 1*a* and the blade 4 may be designed, for example, according to U.S. Pat. No. 3,470,588.

It will be understood that the above description of the present invention is susceptible to various modifications, changes and adaptations, and the same are intended to be comprehended within the meaning and range of equivalents of the appended claims.

What is claimed is:

1. Apparatus for opening and cleaning fiber tufts, comprising: a rotatably mounted cylinder with a card clothing mounted on its circumference for gripping tufts and conveying them; means for pneumatically feeding a mixture of tufts and air toward said cylinder circumference to strike said cylinder while traveling in a direction having a component opposite to the direction of movement of the portion of said cylinder which is struck by the mixture; cleaning elements operatively associated with said cylinder; a wall defining with said cylinder an air gap extending in the direction of flow of such mixture; a first channel connected with said gap for extracting air from the mixture substantially free of the tufts; and means including a second channel separate from said first channel for discharging cleaned tufts.

2. Apparatus as defined in claim 1 wherein said feeding means comprise a channel which narrows to a constriction in the direction of flow, and said cylinder is disposed in the area of the constriction.

3. Apparatus as defined in claim 2 further comprising an air permeable comb disposed in the immediate vicinity, and ahead, of the constriction so as to deflect the fiber tufts in the direction toward said cylinder and to allow passage of the air through said comb substantially free of the tufts.

4. Apparatus according to claim 2 or 3 wherein said wall is provided with at least one opening in the immediate vicinity of, and behind, the constriction and further comprising a suction source communicating with said opening to a source of suction air.

* * * * *